US012778259B2

(12) United States Patent
Li et al.

(10) Patent No.: US 12,778,259 B2
(45) Date of Patent: Nov. 3, 2026

(54) KIND OF DOUBLE DUCT HAIRDRYER

(71) Applicant: SHENZHEN SHUGE MEDICAL BEAUTY DEVICES CO., LTD., Shenzhen (CN)

(72) Inventors: Yingying Li, Shenzhen (CN); Zuowo Xie, Shenzhen (CN); Sijia Chen, Shenzhen (CN); Shengbiao Lin, Shenzhen (CN)

( * ) Notice: Subject to any disclaimer, the term of this patent is extended or adjusted under 35 U.S.C. 154(b) by 449 days.

(21) Appl. No.: 18/289,793

(22) PCT Filed: Apr. 14, 2023

(86) PCT No.: PCT/CN2023/088421
§ 371 (c)(1),
(2) Date: Nov. 7, 2023

(87) PCT Pub. No.: WO2024/037004
PCT Pub. Date: Feb. 22, 2024

(65) Prior Publication Data

US 2025/0089872 A1 Mar. 20, 2025

(30) Foreign Application Priority Data

Aug. 17, 2022 (CN) ..... 202210985554.6

(51) Int. Cl.
*A45D 20/00* (2006.01)
*A45D 20/08* (2006.01)
(Continued)

(52) U.S. Cl.
CPC ..... *A45D 20/12* (2013.01); *A45D 2200/202* (2013.01)

(58) Field of Classification Search
CPC ..... A45D 20/12; A45D 20/00; A45D 20/08; A45D 20/48; A45D 20/26
(Continued)

(56) References Cited

FOREIGN PATENT DOCUMENTS

CN 201370228 Y 12/2009
CN 105942698 A 9/2016
(Continued)

OTHER PUBLICATIONS

English translation of CN110236282 by PE2E Mar. 13, 2026.*
English translation of CN 205963260 by PE2E Mar. 13, 2026.*

*Primary Examiner* — Deming Wan

(57) ABSTRACT

That published in this invention belongs to the technical field of blower, it is concretely a kind of double duct hairdryer, including the shell components, which is internally mounted with the driving component, conduction heating component and exhaust component, the internal components can be installed and be set as straight shape, the driving component is mounted at the internal right end of the shell component, and by the plasma technique with double emitter, it can release positive ion and negative ion at the same time, and it can quickly neutralize positive charges and negative charges after acting on hair, so that hair is soft and bright, being designed as the air duct with double outlets in a straight line and by means of airstream rectification, this invention reduces the loss of wind rate in the air duct, so as to increase the wind speed and wind rate, by the design of air duct with double outlet, hollow slot can be utilized to let air be held between the two outlets, so that the contact area of hair and wind is larger, the efficiency of hair drying is improved, meanwhile, the hollow design of double outlets facilitates simple operation of hair styling.

9 Claims, 15 Drawing Sheets

(51) Int. Cl.
*A45D 20/12* (2006.01)
*A45D 20/26* (2006.01)
*A45D 20/48* (2006.01)

(58) Field of Classification Search
USPC ..... 34/96, 97, 283
See application file for complete search history.

(56) References Cited

FOREIGN PATENT DOCUMENTS

| | | | | | |
|---|---|---|---|---|---|
| CN | 205963260 | U | * | 2/2017 | ..... A45D 20/12 |
| CN | 208228558 | U | | 12/2018 | |
| CN | 110236282 | A | * | 9/2019 | ..... A45D 24/04 |
| CN | 216123966 | U | | 3/2022 | |
| CN | 115299688 | A | | 11/2022 | |
| JP | 2020195702 | A | | 12/2020 | |

* cited by examiner

KIND OF DOUBLE DUCT HAIRDRYER

TECHNICAL FIELD

This invention involves the technical field of hairdryer, and it is concretely a kind of double duct hairdryer.

PRIOR ART

High-speed hairdryer is gradually becoming the mainstream product in market, it is different from ordinary hairdryer, since brushless motor is adopted in high-speed hairdryer, and the blade wheel merely driven by the motor of itself can reach sufficiently strong wind force, and it can surely attain the effect of high efficiency and quick drying at the time of blowing air, meanwhile, brushless motor not only has higher revolving speed, but also has greater wind force, lower noise and longer life, but the high-speed hairdryers in the present market are seriously homogeneous, most of the high-speed hairdryers are "T" shaped, air comes into it from the bottom of handle and goes out from its head, their volume is comparatively big and function is single, meanwhile, loss of wind rate in the "T" shaped air duct is relatively big, women has the demand to hair styling while having demand to hair drying when they use hairdryer, but existing hairdryer usually need to be aided by other tools for hair styling, such as head comb, which is combined with the use of both hands, that is very inconvenient.

Therefore, we have put forward a kind of double duct hairdryer.

CONTENT OF INVENTION

In view of the problems that exist in the above-mentioned and/or existing a kind of double duct hairdryer, I have put forward this invention.

Therefore, object of the invention is to provide a kind of double duct hairdryer, which, by the air duct with double outlets designed as straight shape and by means of airstream rectification, reduces the loss of wind rate in the air duct, and it can utilize the hollow slot, so as to hold hair between two air outlets, so that the contact area between hair and wind is greater, meanwhile, the design of being hollow with double air outlets can facilitate simple operation of hair styling, and it can solve the existing problems posed above.

In order to solve the above-mentioned technical problems, according to one aspect of this invention, the following technical scheme is put forward in this invention:

A kind of double duct hairdryer, which includes:

Shell component, which is internally mounted with the driving component, conduction heating component and exhaust component, it can perform installation of internal components, and it set as a straight shape;

Driving component, which is mounted at the internal right end of the shell component, and by the plasma technique with double emitter, it can release positive ion and negative ion at the same time, and it can quickly neutralize positive charges and negative charges after acting on hair, so that hair is soft and bright;

Conduction heating component, which is mounted at the internal middle part of the shell component, it can heat the air that is blown out, and it adjust the exhaust from the exhaust component;

Exhaust component, which is mounted at the internal left end of the shell component, and by the internally hollow design of air duct with double outlets, pressure intensity difference is formed, suction of the surrounding air is performed by the vacuum area produced by it, so as to increase the wind speed at the air outlet.

As a kind of optimal scheme for a kind of double duct hairdryer said in this invention, the shell component said in it includes:

Outer shell, which is internally mounted with driving component, conduction heating component and exhaust component, and the internal components are installed and put, and it is set as straight shape;

Filter screen, which is mounted at the port of the internal right end of the outer shell, and it blocks outside hair;

Tail cover magnet, which is mounted at the right end of the filter screen;

Tail cover, which is mounted at the right end of the tail cover magnet, and the filter screen is fixed to the port of the internal right end of the other shell;

Tail gate, which is mounted at the right end of the outer wall of the tail cover, and it can discharge the line.

As a kind of optimal scheme for a kind of double duct hairdryer said in this invention, the outer shell in it includes:

Filtration pore, which is set at the right end of the outer wall of the outer shell, and it blocks impurities through the filter screen.

As a kind of optimal scheme for a kind of double duct hairdryer said in this invention, the driving component said in it includes:

Support frame, which is mounted at the internal right end of the outer shell, it is set as two groups, and the main function PCB panel and motor are internally installed;

Key PCB panel, which is mounted at the outer wall of the support frame at the lower end;

Key which is fixed into the key hole of the outer shell, and it is linked onto the key PCB panel.

As a kind of optimal scheme for a kind of double duct hairdryer said in this invention, the support frame said in it includes:

Main function PCB panel, which is mounted at the right end between two groups of support frames, and it is electrically connected key PCB panel, which can perform mode selection;

Motor, which is installed inside the silicone rubber sleeve of motor, and it can produce wind force through rotation;

Fastener, which is mounted between the left ends of two groups of support frames, and it is the internal structure for fastening the entirety after the internal parts are finally pushed into the outer shell, since it is installed to the interior of two groups of support frames from the back side located on the outer shell;

Magnet, which is mounted at both ends of the filter screen, and it can fix the filter screen;

Silicone rubber sleeve of motor, which is mounted at the interior of the motor bracket, and it perform limiting to the motor;

The left end of the motor bracket is mounted at the internal right end of the exhaust component, and it can fix the silicone rubber sleeve of motor, meanwhile, it can perform limiting installation to the heater.

As a kind of optimal scheme for a kind of double duct hairdryer said in this invention, in it, there is plasma generator on the upper end of the main function PCB panel, and it is linked into the two holes on the top of fan drum through two lead wires.

As a kind of optimal scheme for a kind of double duct hairdryer said in this invention, in it, the conduction heating component includes:

Heater, which is commonly composed of mica sheet and heating wire, it is fixed at the interior of fan drum, meanwhile, one end of the mica sheet is fixed into the slot on the upper end of the motor bracket.

As a kind of optimal scheme for a kind of double duct hairdryer said in this invention, in it, the exhaust component includes:

Guide vane, which is mounted at the interior of fan drum, and it adjust the fluid motion trajectory and flow of fan drum;

Top cover, which is mounted at the left end of the fan drum, and it can perpendicularly blow air out through the internally mounted guide vane;

Fan drum, which is mounted at the internal left end of the outer shell, by the design of air duct with double outlets that is internally hollow, pressure intensity difference is formed, suction of the surrounding air is performed by the vacuum area produced by it, so as to increase the wind speed at the air outlet.

As a kind of optimal scheme for a kind of double duct hairdryer said in this invention, in it, the top cover includes:

Air outlet, which is set at both sides at the front end of the top cover, it correspondingly matches with the air outlet of the fan drum, and it can perpendicularly blow out the air that is blown out from the fan drum.

As a kind of optimal scheme for a kind of double duct hairdryer said in this invention, in it, the top cover is set as U shape, hair can be put at its interior, and hair can be blown dry and styled by it.

Compared with Existing Technique:

The internal components can be installed through the shell component, it is set as straight shape, it can reduce the loss of wind rate in the air duct through airstream rectification, so as to increase the wind speed and wind rate;

By the driving component, and by the plasma technique with double emitter, it can release positive ion and negative ion at the same time, and it can quickly neutralize positive charges and negative charges after acting on hair, so that hair is soft and bright;

It can heat the air that is blown out, and it adjust the exhaust from the exhaust component, the wind rate is shunted by the vane, the head loss of wind flow, so as to increase the wind speed and wind rate, the noise produced by head loss is reduced, and it has good effect of thermal insulation and fire prevention;

By the exhaust component, by the design of air duct with two outlet that is internally hollow, pressure intensity difference is formed, suction of the surrounding air is performed by the vacuum area produced by it, so as to increase the wind speed at the air outlet, and by the design of air duct with two outlets, the hollow slot can be utilized to hold hair between two air outlets, so that the contact area between air and wind is bigger, and the efficiency of air drying is improved.

DRAWING EXPLANATION

Figure 1:
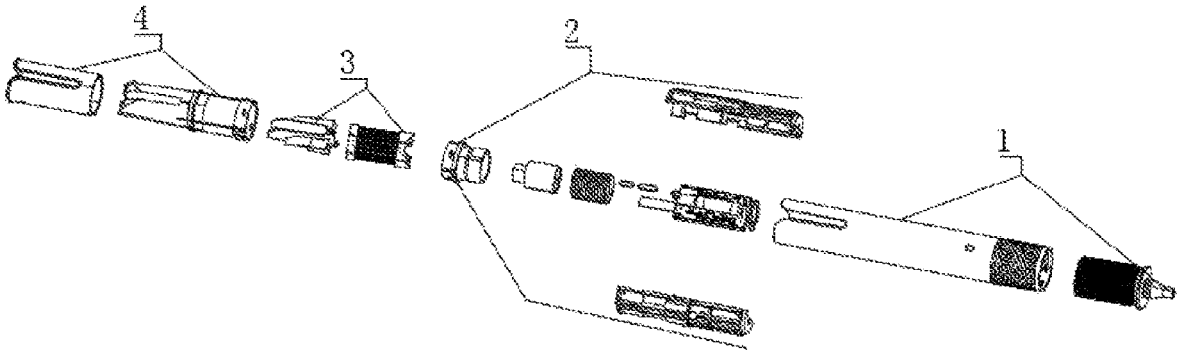
FIG. 1 is the schematic diagram for the overall split structure provided by this invention.
Figure 2:
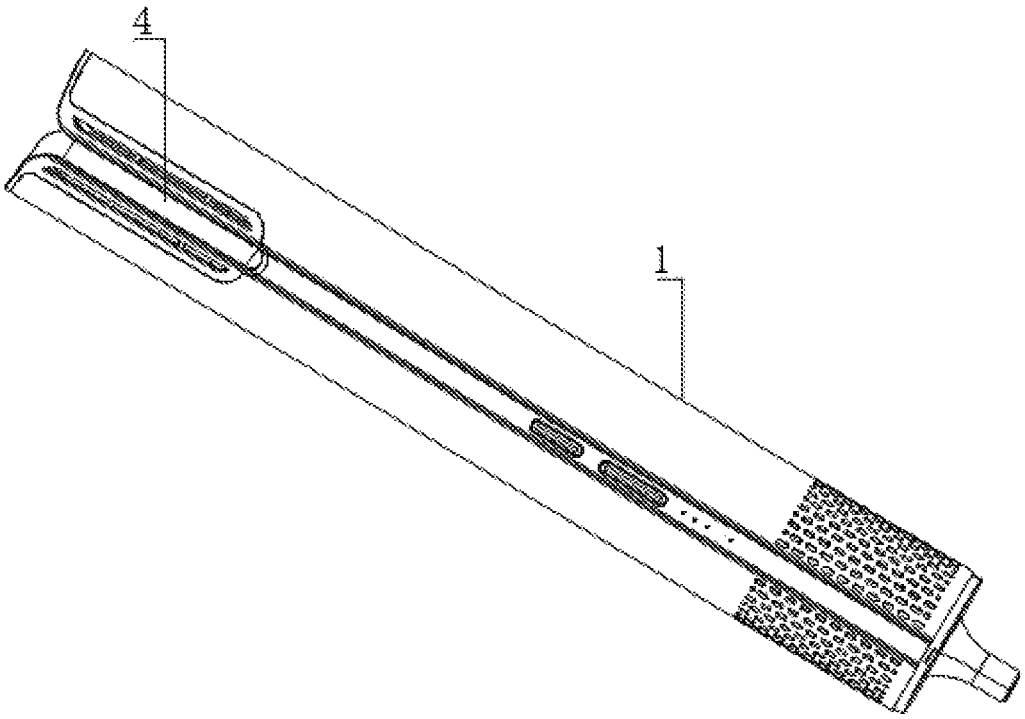
FIG. 2 is the schematic diagram for the overall structure provided by this invention.
Figure 3:
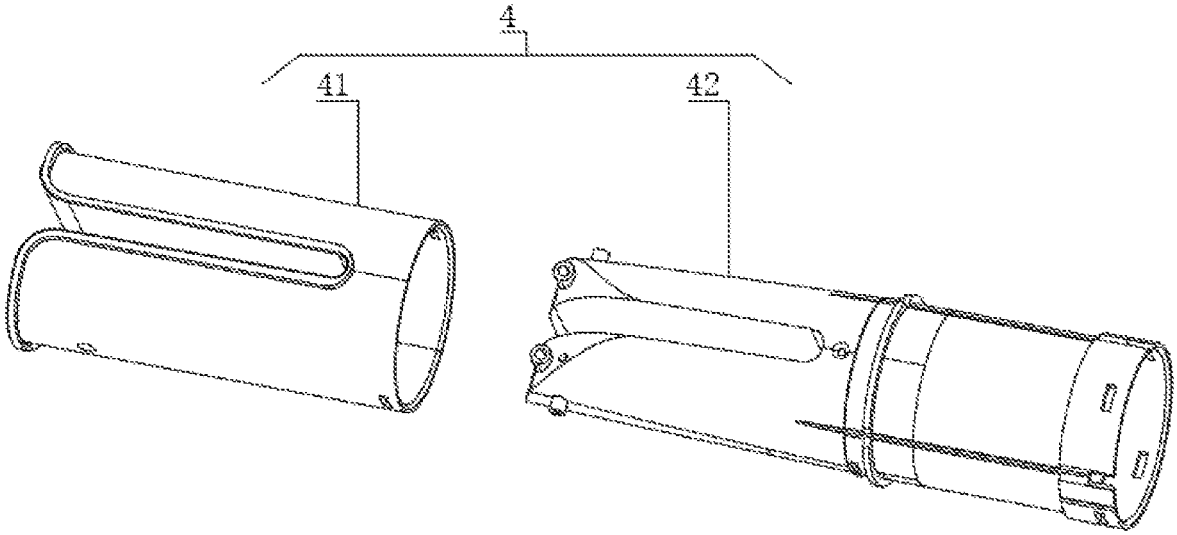
FIG. 3 is the schematic diagram for the split structure of the exhaust component provided by this invention.
Figure 4:
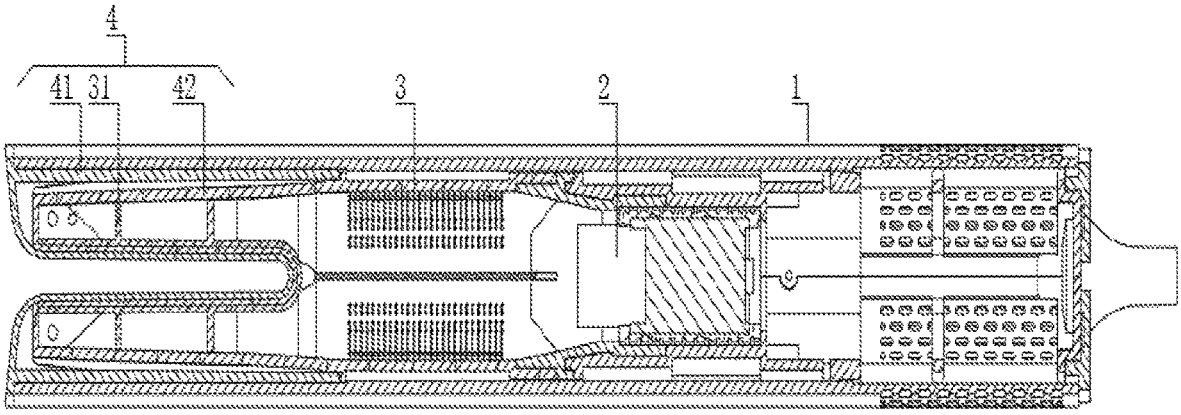
FIG. 4 is the schematic diagram for the overall section structure provided by this invention.
Figure 5:
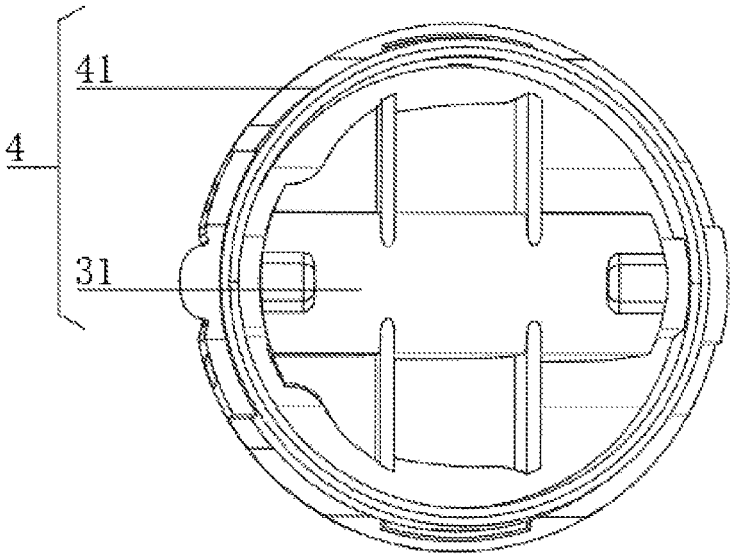
FIG. 5 is the schematic structure for the right-view structure of the exhaust component provided by this invention.
Figure 6:
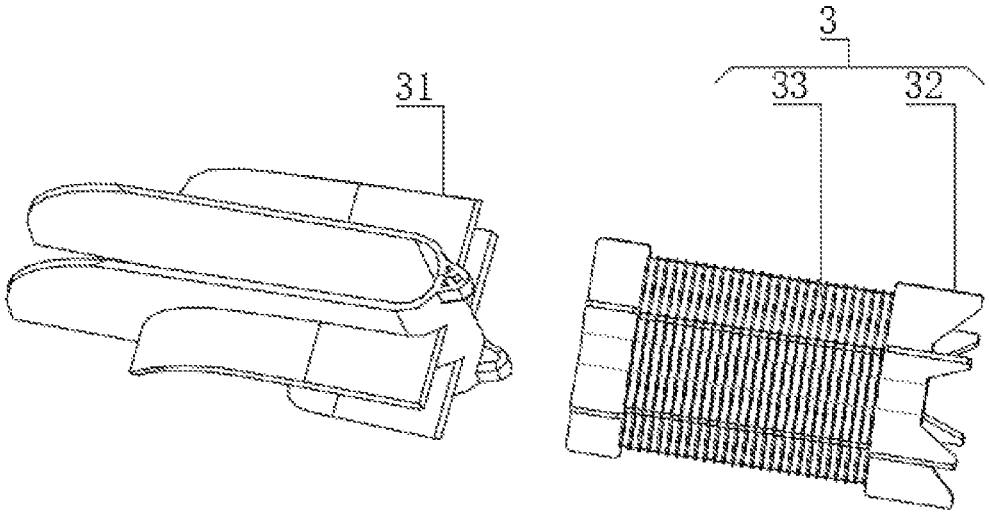
FIG. 6 is the schematic diagram for the split structure of the conduction heating component provided by this invention.
Figure 7:
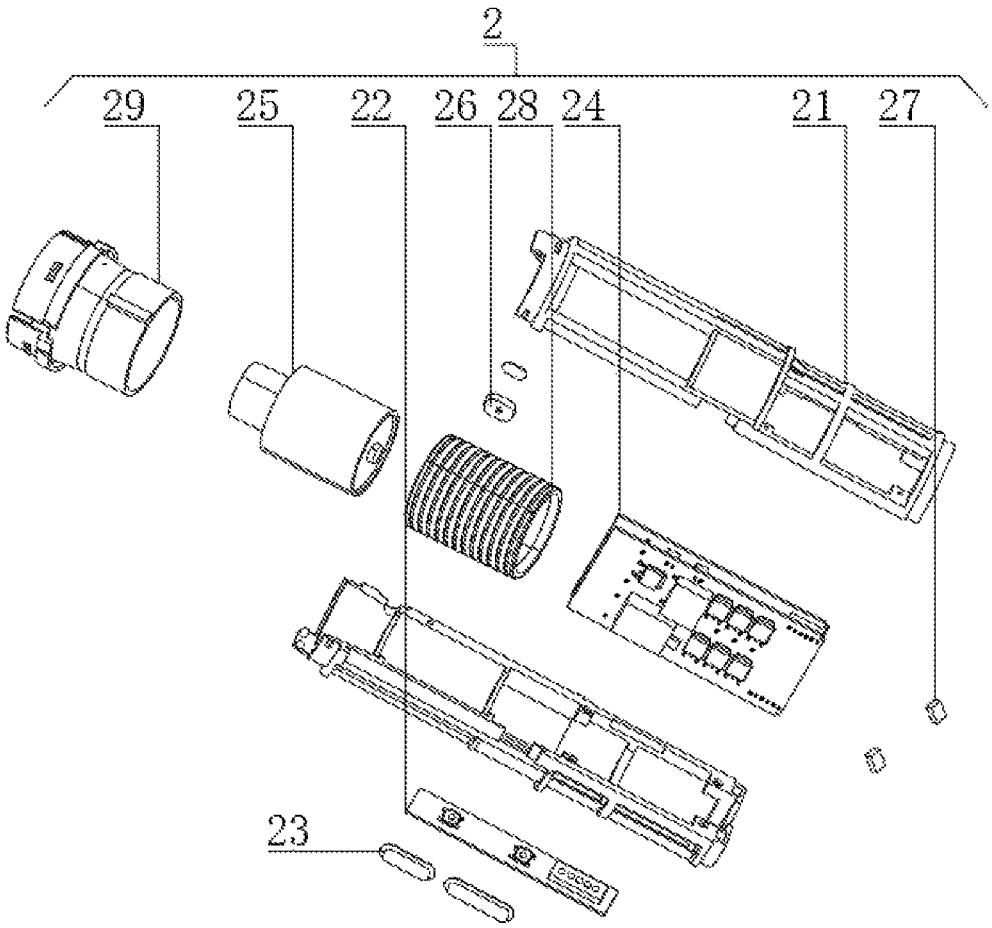
Figure 8:
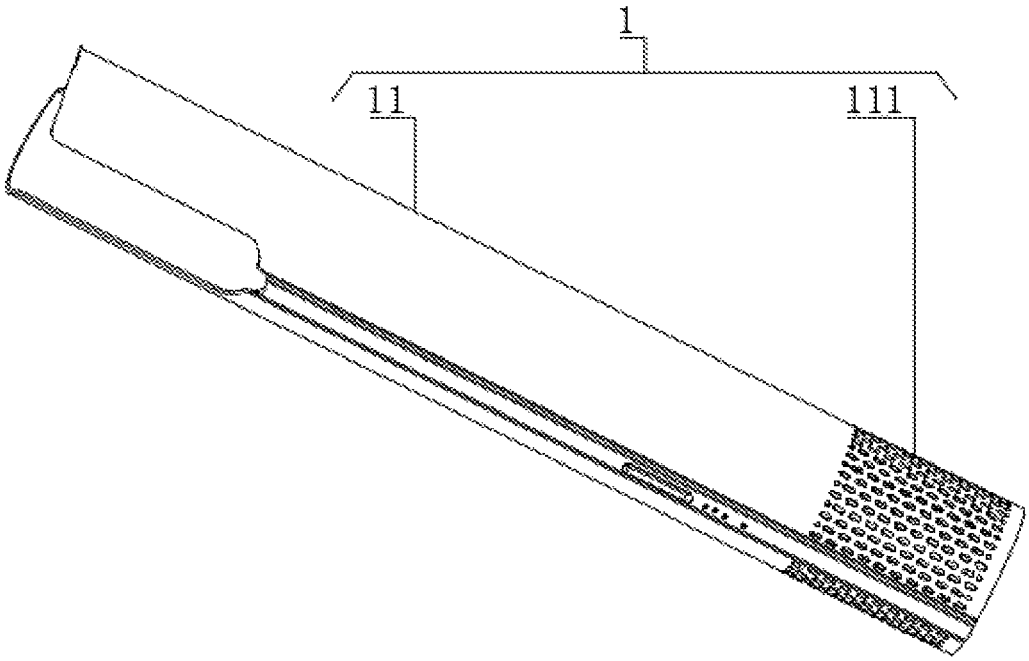
Figure 9:
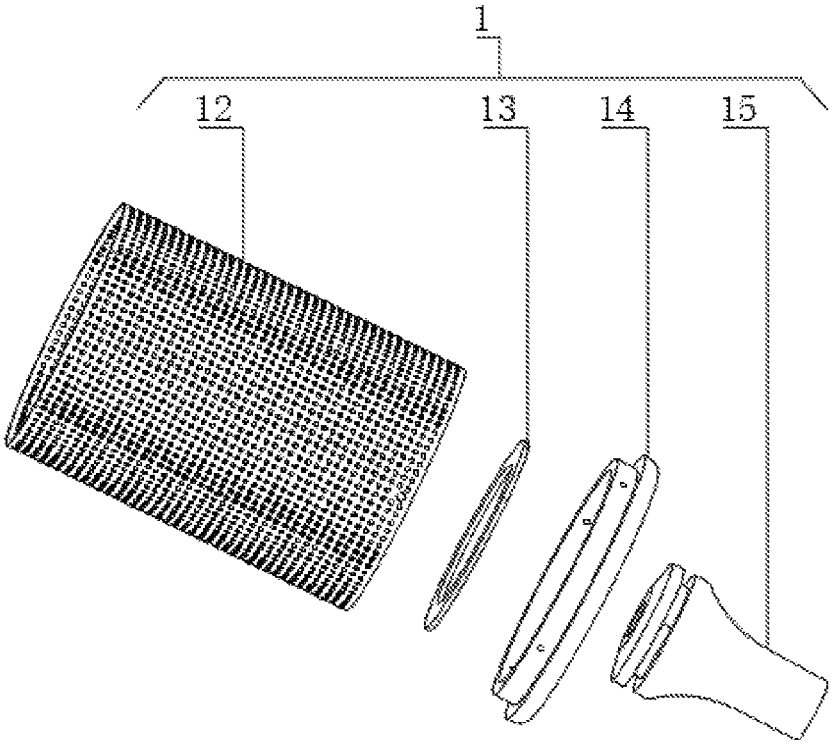
Figure 10:
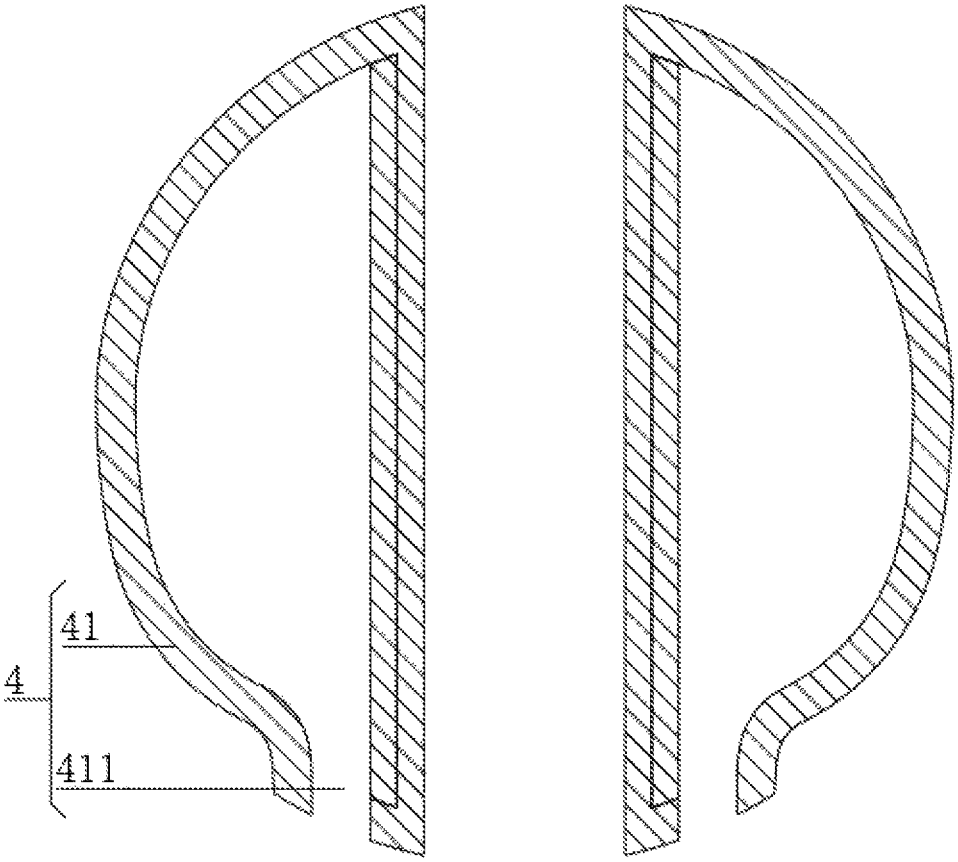
Figure 11:
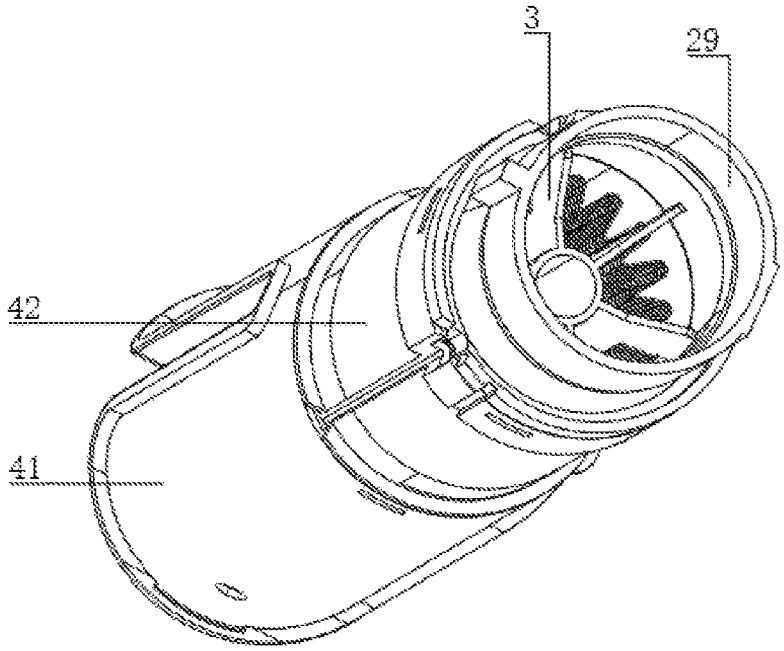
Figure 12:
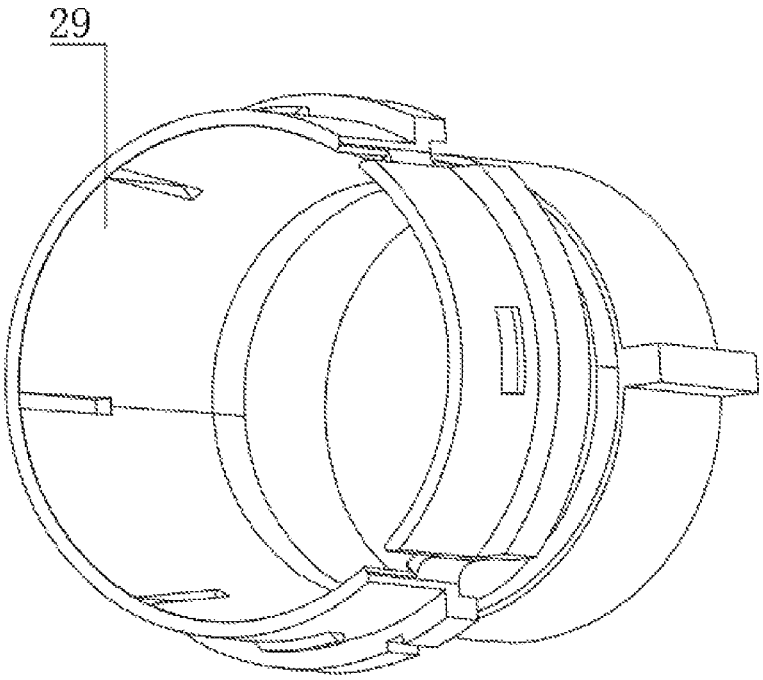
Figure 13:
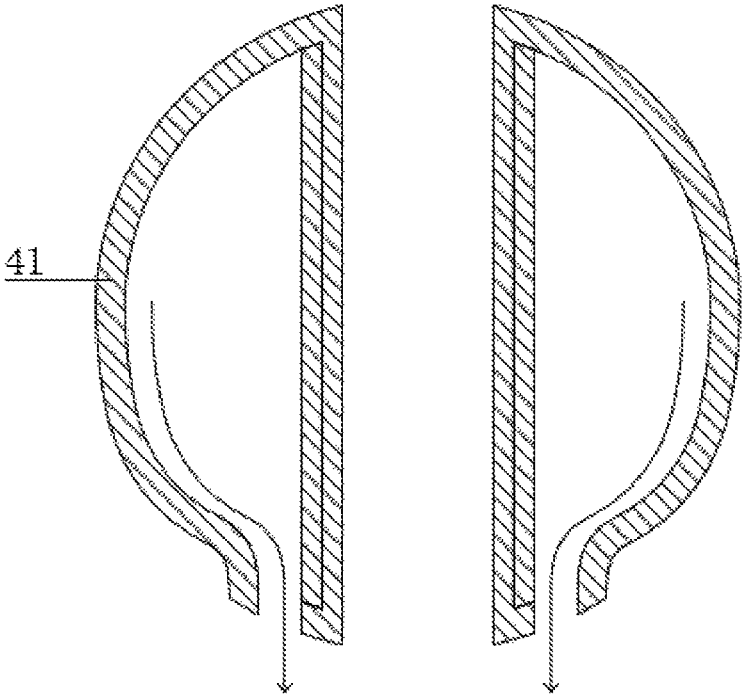
Figure 14:
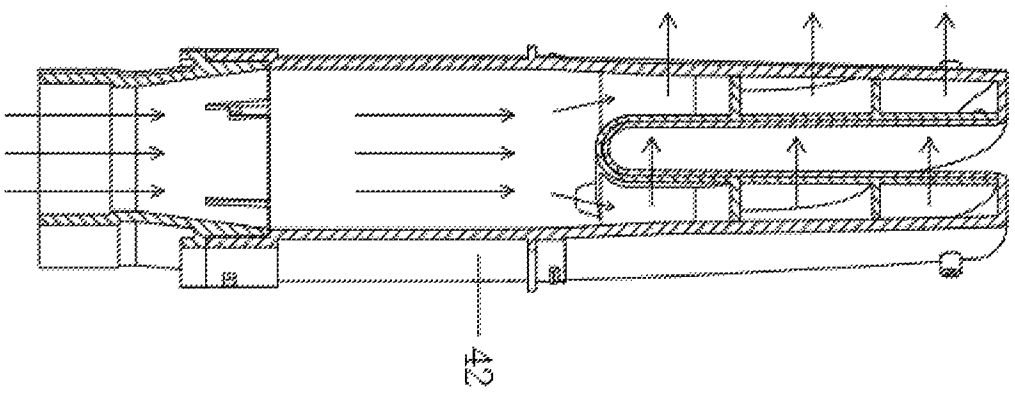
Figure 15:
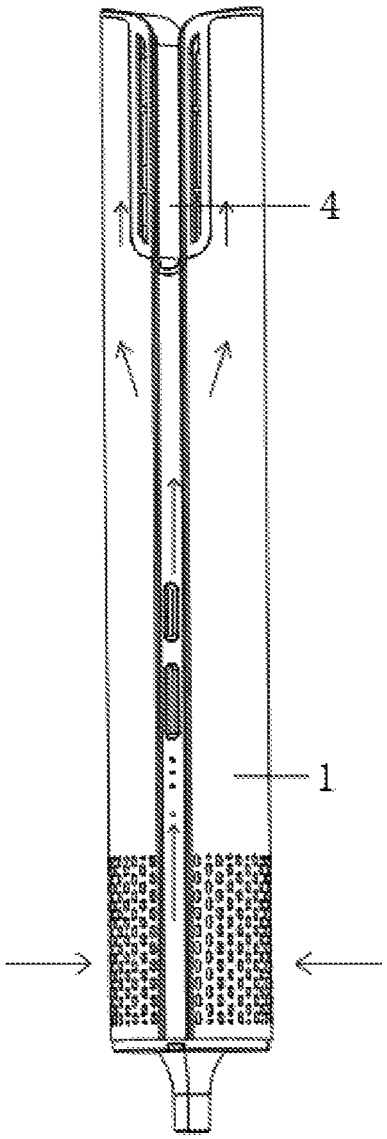

FIG. 7 the schematic diagram for the split structure of the driving component provided by this invention;

FIG. 8 is the schematic diagram for the outer shell structure provided by this invention;

FIG. 9 is the schematic diagram for the split structure of the shell component provided by this invention;

FIG. 10 is the schematic diagram for the sectional structure of the exhaust component provided by this invention;

FIG. 11 is the schematic diagram for the fan drum linking structure provided by this invention;

FIG. 12 is the schematic diagram for the motor bracket structure provided by this invention;

FIG. 13 is the schematic diagram for the sectional wind direction of the exhaust component provided by this invention;

FIG. 14 is the schematic diagram for the wind direction of the internal air duct section provided by this invention;

FIG. 15 is the schematic diagram for the overall wind direction provided by this invention.

Where: shell component 1, outer shell 11, filtration pore 111, filter screen 12, tail cover magnet 13, tail cover 14, tail gate 15, driving component 2, support frame 21, key PCB panel 22, key 23, main function PCB panel 24, motor 25, fastener 26, magnet 27, silicone rubber sleeve of motor 28, motor bracket 29, conduction heating component 3, mica sheet 32, heater 33, exhaust component 4, guide vane 31, top cover 41, air outlet 411, fan drum 42.

DESCRIPTION OF THE PREFERRED EMBODIMENTS

To make the object, technical scheme and advantage of this invention be more clear, combined with the patent drawing, the performing mode of this invention is further described in detail.

This invention provides a kind of double duct hairdryer, by the air duct with double outlets 411 designed as straight shape and by means of airstream rectification, it can reduce the loss of wind rate in air duct, increase wind speed and wind rate, and by the design of air duct with double outlets 411, the hollow slot can be utilized to hold hair between the two air outlets, so that the contact area between hair and wind is bigger, so as to improve the efficiency of hair drying, meanwhile, by the design of being hollow with double outlets, it has the advantage of facilitating simple operation of hair styling, please refer to FIG. 1-5, which includes the shell component 1, driving component 2, conduction heating component 3 and exhaust component 4;

The shell component 1 is internally mounted with driving component 2, conduction heating component 3 and exhaust component 4, the internal components can be installed through shell component 1, and it is set as straight shape, so as to reduce the loss of wind rate in the air duct through airstream rectification, increase the wind speed and wind rate, shell component 1 includes: outer shell 11, filtration pore 111, filter screen 12, tail cover magnet 13, tail cover 14 and tail gate 15, the outer shell 11 is internally mounted with driving component 2, conduction heating component 3 and exhaust component 4, the internal components are installed and put, and it is set as straight shape, so as to reduce the loss of wind rate in the air duct through airstream rectification, increase wind speed and wind rate, the filtration pore 111 is set at the right end of outer wall of the outer shell 11, and it blocks impurities through filter screen 12, the magnetic absorption structure facilitates detaching and clearing by users, the filter screen 12 is mounted at the port of the right end in interior of outer shell 11, and it blocks outside hair, the tail cover magnet 13 is mounted at the right end of filter screen 12, and perform limiting to filter screen 12, the tail cover 14 is mounted at the right end of the tail cover magnet 13, and it fixes filter screen 12 to the port of the right end in interior of outer shell 11, tail gate 15 is mounted at the right end of the outer wall of tail cover 14, and it can discharge the line, it is fixed onto tail cover 14 through filter screen 12, and it is fixed by screw, the detachable filer screen 12 is partly fixed into the gap of outer shell 11 and support frame 21, it is magnetically attracted and fixed through magnet 27, and when a user uses it for a long time, large quantities of dust (etc.) can be absorbed onto filter screen 12, it needs to be cleared in time, otherwise the air inlet might be blocked, and it can avoid affecting the operation of motor 25, and the magnetic absorption structure facilitates detaching and clearing by user;

The driving component 2 is mounted at the right end of the interior of shell component 1, with the driving component 2, and by the plasma technique with double emitter, it can release positive ion and negative ion at the same time, and it can quickly neutralize positive charges and negative charges after acting on hair, so that hair is soft and bright, the driving component 2 includes support frame 21, key PCB panel 22, key 23, main function PCB panel 24, motor 25, fastener 26 and magnet 27, support frame 21 is mounted at the right end of the interior of outer shell 11, it is set as two groups, and the main function PCB panel 24 and motor 25 are internally installed, key PCB panel 22 is mounted at the outer wall of the support frame 21 at lower end, key PCB panel 22 and main function PCB panel 24 are electrically connected, it can perform operation to the main function PCB panel 24, key 23 is mounted into the key hole of outer shell 11, and it is linked onto key PCB panel 22, main function PCB panel 24 is mounted at the right end between two groups of support frames 21, and it is electrically connected with the key PCB panel 22, mode selection is available, and it is electrically connected with motor 25, it can control the starting and closing of motor 25, motor 25 is mounted at the interior of the silicone rubber sleeve of motor 28, and it can produce wind force through rotation, fastener 26 is mounted between the left ends of two groups of support frame 21, and it is the internal structure for fastening the entirety after finally pushing the internal part into outer shell 11, it is mounted to the interior of two groups of support frames 21 from the back side located at outer shell 11, magnet 27 is mounted at both ends of filter screen 12, and it can fix filter screen 12, there is plasma generator on the upper end of main function PCB panel 24, and it linked into two holes on the top of fan drum 42 through two lead wires, the plasma generator outputs two lead wires, whose tail ends are respectively the carbon brush of positive ion generator and the carbon brush of negative ion generator, silicone rubber sleeve of motor 28 is mounted at the interior of motor bracket 29, and it 对 performs limiting to motor 25, the left end of motor bracket 29 is mounted at the internal right end of exhaust component 4, and it can fix silicone rubber sleeve of motor 28, meanwhile, it can perform limiting installation to heater 33, motor 25 is externally wrapped with silicone rubber sleeve of motor 28, they are fixed into the interior of motor bracket 29, by the elasticity of silicone rubber sleeve of motor 28, it tightly fit and fixed with motor bracket 29, there is one round of limit step on motor bracket 29, so as to locate motor 25 and silicone rubber sleeve of motor 28, the lower half parts of motor 25 and silicone rubber sleeve of motor 28 are fixed into support frame 21, and there is also one round of limit step, and the upper and lower limit steps commonly locate motor 25 and silicone rubber sleeve of motor 28;

Among them, there are left and right holes at the fitting part of motor bracket 29 and fan drum 42, they are used for the electric wire from motor 25 and the connection wire between heater 33 and 17 main function PCB panel 24, after the electric wire of motor 25 and the electric wire of heater 33 penetrates out of the holes, the holes are sealed by sealant, so as to guarantee the tightness of the interior of air duct;

There is no static electricity on hair when it is wet, but when moisture evaporates under the effect of fan drum, static electricity might be produced between hairs after mutual friction, since the friction caused by fluid is disordered, so both positive charge and negative charge can be produced, since the flowrate of high-speed motor is quicker, it is more prone to cause static electricity, but the negative ion of single emitter can only neutralize the positive charge in the static electricity, and because of the phenomenon of repulsion, the remaining negative charge might still cause disorder of hair, but the plasma technique with double emitters can release positive ion and negative ion at the same time, it can neutralize the positive charge and negative charge after acting on hair, so that hair is soft and bright, and that is not only the process of hair drying, but also it has the same effect when it is used for blowing style;

Conduction heating component 3 is mounted at the internal middle part of shell component 1, the air that is blown out can be heated through it, and the exhaust of the exhaust component 4 can be adjusted, the wind rate can be shunted by vanes, so as to reduce the head loss of wind flow, so as to increase the wind speed and wind rate, the noise produced by head loss is reduced, since the heating component is not just aligned with the air outlet, and there is a certain distance, so it has excellent fireproof effect, the conduction heating component 3 includes: mica sheet 32 and heater 33, heater 33 is commonly composed of mica sheet 32 and heating wire, and it is fixed to the interior of fan drum 42, meanwhile, one end of mica sheet 32 is fixed into the slot on the upper end of motor bracket 29;

Exhaust component 4 is mounted at the left end of interior of shell component 1, and by the design of air duct with two air outlets that is internally hollow, exhaust component 4 forms pressure intensity difference, suction of the surrounding air is performed by the vacuum area produced by it, so as to increase the wind speed at the air outlet, the hollow slot can be utilized by the design of air duct with two air outlet, so as to hold hair between two air outlet, so that the contact area between hair and wind is greater, the efficiency of hair drying is improved, exhaust component 4 includes guide vane 31, top cover 41, air outlet 411 and fan drum 42, guide vane 31 is mounted at the interior of fan drum 42, it can adjust the fluid motion trajectory and flow of fan drum 42, guide vane 31 respectively divides the two air outlet into three small air outlets, the quantity of air outlet can also be adjusted by regulating the vane quantity of guide vane, by adding 3 guide vane into the air duct, the wind direction is changed by conduction, so that the wind direction of air outlet is perpendicular to the air outlet, meanwhile, the wind rate in unit area of two air outlet is homogenous, and the wind rate is shunted by vane, so as to reduce the head loss of wind flow, increase the wind speed and wind rate, decrease the noise produced by head loss, when it is used, fluid enters the device through the air inlet at the bottom of machine body, through motor 25 and then through the heating rack inside fan drum 42, it is divided into certain portion through guide vane 31, and it is finally blown out from two groups of air outlets 411 of top cover 41, so as to finish the flowing track of fluid, top cover 41 is mounted at the left end of fan drum 42, and by the internally installed guide vane 31, it can perpendicularly blow out air, air outlet 411 is set at both ends of the front end of top cover 41, and it correspondingly matches with the air outlet of fan drum 42, it can perpendicularly blow out the wind that is blown out from fan drum 42, top cover 41 is set as U shape, and hair can be put into interior, so as to perform blowing dry and styling to hair, fan drum 42 is mounted at the left end of interior of outer shell 11, and by the design of air duct with two air outlet that is internally hollow, pressure intensity pressure is formed, suction of the surrounding air is performed by the vacuum area produced by it, so as to increase the wind speed at the air outlet, and at the time of hair drying, hair is held at the hollow part and is blown along the direction of the wind direction, the evaporation of moisture on hair can be quickened, the dimension of the hollow part is adjustable, when fan drum 42 and guide vane 31 match, there is gap in the middle of air duct, and the gap is covered through top cover 41, so as to avoid air leakage;

Among them, as shown in FIG. 10, there is arc angle at the air outlet of fan drum 42, its effect is to reduce the head loss of fluid, increase wind speed and wind rate as well as reduce wind noise at the same time, the size of arc angle is adjustable, and it is within the protection scope.

At the time of concrete using, the technical personnel in this field energizes the device, by pressing of key 23 to touch key PCB panel 22, so that the main function PCB panel 24 is started according to the selected mode, then motor 25 and heater 33 begin to work, hair is put to the interior of top cover 41, hair is held between two air outlets, so that the contact area between hair and wind is greater, the efficiency of hair drying is improved, and through the air inlet at bottom of machine body, air outlet 411 makes fluid enter the device, it passes through plasma generator and motor 25, then it passes the heating rack inside fan drum 42, then it is divided into certain portions by guide vane 31, it is finally blown out from two groups of air outlet 411 of top cover 41, then the wind blown out of air outlet 411 is perpendicular wind, and by the design of air duct with two air outlets that is hollow, pressure intensity difference is formed, suction of the surrounding air is performed by the vacuum area produced by it, so as to increase the wind speed at the air outlet, and hair is blown dry.

This invention was described in the above text in reference to the performing mode, but under the circumstance of being not far from the scope of this invention, various improvement can be performed to it, and the parts in it can be substituted by equivalents, especially, so long as there being no structural conflict, various features in the performing mode disclosed by this invention can be used by random mode of mutual combination, exhaustive description is not performed to those combinations in this specification, the reason is only to save space and economize resource. Therefore, this invention is not restricted to the specific performing mode published in this text, instead, it includes all technical schemes that are within the scope of the claim.

The invention claimed is:

1. A kind of double duct hairdryer, which is characterized by, including:

a Shell component (1), whose interior is mounted with a driving component (2), a conduction heating component (3) and an exhaust component (4), and the internal components can be are installed and set as straight shape;

the Driving component (2), is mounted at the internal proximal end of the shell component (1), and is equipped with a double-emitter plasma structure, the double-emitter plasma structure releases positive ion and negative ion at the same time, the positive ion and negative ion quickly neutralize positive charges and negative charges after acting on hair, so that hair is soft and bright;

the Conduction heating component (3), is mounted at the internal middle part of the shell component (1), the Conduction heating component (3) heat the air that is blown out;

the Exhaust component (4), is mounted at the internal distal end of the shell component (1), and by an internally hollow design of air duct with double outlets, pressure intensity difference is formed, suction of the surrounding air is performed by a vacuum area produced by the pressure intensity difference, so as to increase the wind speed at the air outlet;

the shell component (1) includes:

an Outer shell (11), its interior is mounted with the driving component (2), the conduction heating component (3) and the exhaust component (4), and the internal components are installed, put and set as straight shape;

a Filter screen (12), which is mounted at the port of the internal proximal end of the outer shell (11), and it blocks outside hair;

a Tail cover magnet (13), which is mounted at the proximal end of the filter screen (12);

a Tail cover (14), which is mounted at the proximal end of the tail cover magnet (13), and it fixes the filter screen (12) to the port of the internal right end of the outer shell (11);

a Tail gate (15), which is mounted at the proximal end of the outer wall of the tail cover (14), and is configured for an electrical wire to pass therethrough.

2. The kind of double duct hairdryer said according to claim 1, it is characterized by: the outer shell (11) includes:

Filtration pore (111), which is set at the proximal end of an outer wall of the outer shell (11), and it blocks impurities through the filter screen (12).

3. The kind of double duct hairdryer said according to claim 1, it is characterized by: the driving component (2) includes:

Support frames (21), are mounted at the internal proximal end of the outer shell (11), and are provided in two groups, and a main function PCB panel (24) and motor (25) are mounted to its interior;

Key PCB panel (22), which is mounted at the outer wall of the support frame (21) at the lower end;

Key (23), which is fixed into a key hole on the outer shell (11), and it is linked onto the key PCB panel (22).

4. The kind of double duct hairdryer said according to claim 3, it is characterized by: the support frame (21) includes:

the Main function PCB panel (24), which is mounted at the proximal end between two groups of support frames (21), and the Main function PCB panel (24) is electrically connected with the key PCB panel (22), the Main function PCB panel (24) configured to perform mode selection;

the Motor (25), which is mounted at the interior of the silicone rubber sleeve of motor (28), and the motor produces wind force through rotation;

a Fastener (26), which is mounted between the distal ends of two groups of support frames (21), and is an internal structure for fastening the entirety after the internal parts is finally put into the outer shell (11), since it is then mounted to the interior of two groups of support frames (21) from the back side located at the outer shell (11);

Magnets (27), are mounted at both ends of the filter screen (12), and fix the filter screen (12);

Silicone rubber sleeve of motor (28), which is mounted at the interior of the motor bracket (29), securing a position of the motor (25);

the left distal end of the motor bracket (29) is mounted at the internal proximal end of the exhaust component (4), the motor bracket (29) fixes the silicone rubber sleeve of motor (28), and the motor bracket (29) is configured to limit the mounting position of the heater (33).

5. The kind of double duct hairdryer said according to claim 4, it is characterized by: there is plasma generator on the upper end of the main function PCB panel (24), and it is connected to a top portion of the fan drum (42) through two lead wires.

6. The kind of double duct hairdryer said according to claim 1, it is characterized by:

the exhaust component (4) includes: a Guide vane (31), a Top cover (41) and a Fan drum (42);

the Guide vane (31), which is mounted at the interior of the fan drum (42), and adjusts the fluid motion trajectory and flow of the fan drum (42);

the Top cover (41), which is mounted at the distal end of the fan drum (42), and perpendicularly blow out air through the internally installed guide vane (31);

the Fan drum (42), which is mounted at the internal distal end of the outer shell (11), and by the design of internally hollow air duct with double outlets, pressure intensity difference is formed, suction of the surrounding air is performed by the vacuum area produced by the pressure intensity difference, so as to increase the wind speed at the air outlet.

7. The kind of double duct hairdryer said according to claim 6, it is characterized by:

the conduction heating component (3) includes:

a Heater (33), which is commonly composed of mica sheet (32) and heating wire, and it is fixed at the interior of the fan drum 42, meanwhile, one end of the mica sheet (32) is fixed into the slot on the upper end of the motor bracket (29).

8. The kind of double duct hairdryer said according to claim 7, it is characterized by: the top cover (41) is configured in a U shape with an interior space capable of receiving hair for drying and styling the hair.

9. The kind of double duct hairdryer said according to claim 6, it is characterized by: the top cover (41) includes:

Air outlets (411), which are disposed on both sides of the distal end of the top cover (41), are correspondingly mated with the outlets of the fan drum (42), and blow airflow discharged from the fan drum (42) vertically outward.

* * * * *